US010092071B1

(12) United States Patent
Sutovsky et al.

(10) Patent No.: US 10,092,071 B1
(45) Date of Patent: Oct. 9, 2018

(54) BAG WITH SHOE POCKETS

(71) Applicant: Rawlings Sporting Goods Company, Inc., St. Louis, MO (US)

(72) Inventors: Anton Sutovsky, O'Fallon, MO (US); Zach Runzo, Lake Saint Louis, MO (US); Michael Kennedy, O'Fallon, MO (US)

(73) Assignee: Rawlings Sporting Goods Company, Inc., St. Louis, MO (US)

( * ) Notice: Subject to any disclaimer, the term of this patent is extended or adjusted under 35 U.S.C. 154(b) by 0 days.

(21) Appl. No.: 15/480,333

(22) Filed: Apr. 5, 2017

(51) Int. Cl.

| | |
|---|---|
| ***A45C 3/12*** | (2006.01) |
| ***A45C 13/02*** | (2006.01) |
| ***A45F 3/04*** | (2006.01) |
| *A45C 3/00* | (2006.01) |

(52) U.S. Cl.
CPC ..... *A45C 3/12* (2013.01); *A45C 13/02* (2013.01); *A45F 3/04* (2013.01); *A45C 2003/007* (2013.01)

(58) Field of Classification Search
CPC ..... A45C 3/12; A45C 5/06; A45C 2003/007
USPC ..... 206/278
See application file for complete search history.

(56) References Cited

U.S. PATENT DOCUMENTS

| | | | | |
|---|---|---|---|---|
| 1,909,942 | A * | 5/1933 | Fingerman | A45C 3/12 206/278 |
| 6,786,375 | B2 * | 9/2004 | Worden | A45C 3/12 206/315.1 |
| 7,111,731 | B2 * | 9/2006 | Pratt | A45C 5/06 150/117 |
| 7,152,771 | B2 * | 12/2006 | Le Gal | A45F 3/047 224/631 |
| 7,467,695 | B2 * | 12/2008 | Gormick | A45C 3/02 190/102 |
| 9,555,308 | B2 * | 1/2017 | Nassanian | A45C 13/02 |
| 2003/0146120 | A1 * | 8/2003 | Chi | A45C 5/06 206/315.5 |
| 2007/0017947 | A1 * | 1/2007 | Fenton | A45C 7/0063 224/650 |
| 2008/0011567 | A1 * | 1/2008 | Hammond | A45C 7/009 190/108 |
| 2013/0322786 | A1 * | 12/2013 | Nassanian | A45C 3/001 383/25 |
| 2014/0352859 | A1 * | 12/2014 | Brown | A45C 13/02 150/112 |
| 2016/0183649 | A1 * | 6/2016 | Gamble | A45C 3/06 150/107 |
| 2017/0215557 | A1 * | 8/2017 | Buck | A45F 3/04 |

* cited by examiner

*Primary Examiner* — Sue A Weaver
(74) *Attorney, Agent, or Firm* — Husch Blackwell LLP

(57) ABSTRACT

An equipment bag having external shoe pockets at its lower side portions is provided. The shoe pockets are substantially in the shape of a shoe. When a shoe is inserted in a shoe pocket, the shoe's sole and cleats associated therewith, abut the side of the bag. The side of the bag that the cleats may abut is preferably reinforced with material to reduce the likelihood of damage to the bag or contents within the bag. The pocket includes expandable mesh side portions that allow the pockets to expand size to better receive shoes, and also to improve airflow through the shoes and reduce shoe odor. An adjustment system is also provided that allows shoes to be more snugly secured within the pockets.

17 Claims, 3 Drawing Sheets

BAG WITH SHOE POCKETS

BACKGROUND OF THE INVENTION

Equipment bags are used by amateur and professional athletes to tote their equipment to and from workouts, practices, and games. For example, baseball players use equipment bags to carry a wide range of equipment including, but not limited to: baseball bats, gloves, batting gloves, batting helmets, pine tar, sunglasses, bat weights (or donuts), baseball cleats, and the like.

Dirt, debris, and other residue from the cleats or shoes can accumulate within a bag when large quantities of equipment are carried in that one bag. This dirt and soil can damage or dirty the other equipment that is within the bag. Moreover, athletic shoes or cleats stored within the bag tend to generate a foul-smelling odor within the bag over time. Such an odor can make the bag smell bad and can even pervade and affect other equipment within the bag. Even moreover, in the case of baseball cleats, the metal (or even plastic) spikes can scratch or otherwise damage equipment within the bag.

To avoid the aforementioned problems, athletes often try to keep their shoes or cleats stored separately from the rest of their equipment. For example, baseball players often hang their shoes from the knobs of their baseball bats or use clip-like devices to clip their shoes to an equipment bag. Some athletes even just carry their shoes separate and apart from their equipment bags at all times. However, these solutions still allow the athlete's shoes to dangle freely, and cleats on the shoes are more likely to scratch cars or other surfaces while carried.

Other athletes may carry the shoes in a shoe bag separate from the equipment bag. Those shoe bags do a good job of eliminating the dirt and debris within the main equipment bag, as well as odor issues. However, when an athlete stores shoes separately from other equipment, he or she must remember the shoes in addition to the equipment bag. Remembering to take more equipment to a game or practice can pose a challenge when an athlete is already concentrating on the game or practice. Moreover, because the product is not actually incorporated into the equipment bag, the accessory may require an additional purchase for the user, and can be unwieldly.

Some bag manufacturers include separate interior pockets intended for carrying the shoes or cleats in their equipment bags. Even with this intended solution, dirt and debris may enter the back and affect other equipment being stored in the bag. Moreover, there is no circulation system to limit the odor that is released by the shoes. Finally, with this solution, the total amount of storage volume is reduced, and an athlete has less room in his or her bag to store other equipment.

Also, in each of the solutions described above where the shoes are stored in a bag (either contained within the equipment bag or separate from the equipment bag), the bags are typically not large enough to fit the cleats of a person having large feet. A person with large feet has shoes that take up more space, and the internal pockets or separate bags are often not large enough.

A further drawback of a bag for storing shoes that is also contained within the equipment bag occurs when the bag (or built-in shoe pocket) is located at the bottom of an equipment bag. It can be very difficult to access the shoes at the bottom of the equipment bag with other objects in the bag above the shoes that must be moved aside. This is especially inconvenient when the shoes are typically the first piece of equipment that is donned by an athlete prior to beginning play.

SUMMARY OF THE INVENTION

An equipment bag with external pockets for receiving and securing shoes within the pockets is provided which aims to solve the aforementioned shortcomings in the prior art. The bag itself may include a plurality of pouches for storing equipment like gloves, batting gloves, sunglasses, and the like therein. Those pouches may be opened and closed using a traditional zipper system. The bag further may include straps such as those common to existing backpacks and bags that are worn on a user's shoulders to help a wearer carry the bag.

The bag also preferably includes sleeve members at its lower side portions for receiving and securing a baseball or softball bat barrel. An external surface of the sleeve portion that is adjacent the shoe pockets discussed below may be reinforced with extra material (e.g., nylon, screen printing). When shoes that have cleats are stored in the shoe pockets so that the cleats on the shoes abut the external surface of the sleeve portions, the extra material may reduce damage to the bag's material and/or to a bat secured within the bat sleeve. At the upper side portions of the bag, loop members may be provided that can fit around a bat handle to secure the bat against the side of the bag during transport.

The shoe pockets are preferably positioned and located at the lower side portions of the bag as well. The pockets are preferably used to hold shoes, but they may be used to hold other objects like sunflower seeds or water bottles just as easily. The pockets may be located outwardly from the sleeve portions described above that are able to receive and secure a bat barrel. The pockets preferably include an upper portion having an opening in which shoes (or other objects) may be inserted. The side portions of the pockets are preferably attached to the bag with mesh panels. The mesh panels are preferably made of an elastic material so that the size of the pocket is expanded when a user is placing shoes into the opening in the pockets. The mesh also allows dirt and debris from shoes to fall through the mesh and not accumulate in the pockets.

The pockets, which include a center panel and two outer panels are preferably formed to be shaped substantially similarly to the shape of a shoe. Thus, when a shoe is secured in the pocket, it is not substantially deformed or altered by the pocket. The pockets are also tapered toward their lower portions so that the toe of a shoe that is inserted into a pocket is securely retained in the lower, deep portion of the pocket.

An adjustment mechanism is also provided that includes a cord member running through the back of each pocket, where it attaches to either side of a pocket. The adjustment mechanism may include a poppet member that controls the tension of the cord member. When the poppet member is pulled outwardly, tension is loosened. This causes the opening in the pocket to increase size, making it easier to put a shoe in the pocket. When the poppet member is pushed inwardly, more tension is introduced in the cord member. Thus, the poppet may cause the size of the opening in the pocket to increase or decrease as tension in the cord member varies. When the opening is closed, the cord member may help to push shoes against the side of the bag and prevent them from falling out.

DETAILED DESCRIPTION OF THE INVENTION

Figure 1:
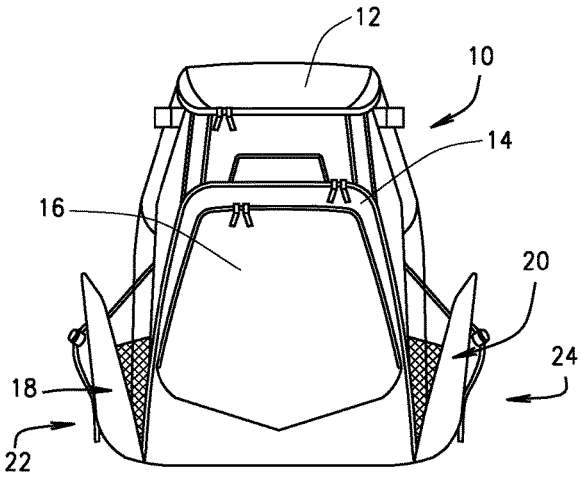
FIG. 1 is a front elevation view of a bag with shoe pockets for storing shoes or cleats constructed in accordance with the teachings of the present invention.

Referring to the drawings more particularly by reference numbers wherein like members refer to like parts, FIG. 1 illustrates a bag 10 for storing sports equipment or other equipment therein. The bag 10 includes multiple pouches for containing equipment. An athlete or other user of the bag 10 may use the pouches to store equipment including, but not limited to, baseball gloves, batting helmets, and batting gloves. The bag 10 illustrated in FIG. 1 includes each of an upper pouch 12, middle pouch 14, and lower pouch 16. The pouches 12, 14, 16 are opened and closed using conventional methods, such as zipper systems (as shown in FIG. 1). Different numbers or positions of such pouches are envisioned.

The bag 10 further includes shoe pockets 18, 20 positioned and located at left and right side portions 22, 24, respectively, of the bag 10. The shoe pocket 20 is further illustrated in FIG. 2, which provides an elevation view of the right side 24 of the bag 10. The shoe pocket 20 and the shoe pocket 18 are both preferably integrally formed with the bag 10. In a preferred embodiment, the shoe pockets 18, 20 are sewn to the side portions 22, 24, respectively, of the bag 10. The shoe pockets 18, 20 are discussed in greater detail below when describing FIGS. 4-7.

The bag 10 also includes adjustable straps 26 (shown in FIGS. 2 and 3) for carrying the bag 10. The straps 26 may be substantially similar to the straps used for traditional backpacks. While the illustrated bag 10 includes two straps 26, other embodiments may include only one strap, or straps located in a different position or location on the bag 10. In at least one embodiment, the bag 10 may include wheels so that it can be wheeled around instead of carried. Such an embodiment may not include shoulder straps at all.

The bag 10 further may include loop members 28 and sleeve members 30 (most clearly shown in FIG. 2) used for securing baseball and/or softball bats therein. The loop members 28 and sleeve members 30 may be positioned and located on both side portions 22, 24 of the bag 10 near an upper portion 32 of the side portions 22, 24. The sleeve members 30 are also located on the side portions 22, 24 of the bag, below the loop members 28. The loop members 28 may be made of a variety of materials, and may be stitched to the bag 10 or otherwise formed integrally with the bag 10. The sleeve members 30 preferably have a closed bottom so that a bat cannot slide through the bottom of either of the sleeve members 30.

When a baseball and/or softball bat is received by either of the loop members 28, the barrel may be pushed barrel-end first downwardly into sleeve members 30. When a bat is inserted barrel-end first such that its barrel is received within a sleeve member 30, the corresponding loop member 28 may be used to secure a handle-end of the bat to the bag 10.

In a preferred embodiment, a loop member 28 is formed from separate straps that are releasably attachable to one another. Thus, for example, the straps of a loop member 28 may be made of a hook-and-loop material. Then, when a bat is received in a sleeve member 30, the straps may be snugly fit around the bat's handle by releasably attaching the strap members to one another. Alternatively, the loop members 28 may connect to one another via some other system that can similarly be used to secure a bat handle to a side portion 22, 24 of a bag. In yet a different embodiment, the loop members 28 may be an elastic loop stitched or otherwise attached to a side portion 22, 24 of the bag 10. In that embodiment, the elastic or other material loop should be sufficiently elastic to allow the barrel of a baseball bat to fit there through. Other materials known or foreseeable to those skilled in the art may also be used to construct the loop members 28.

Figure 2:
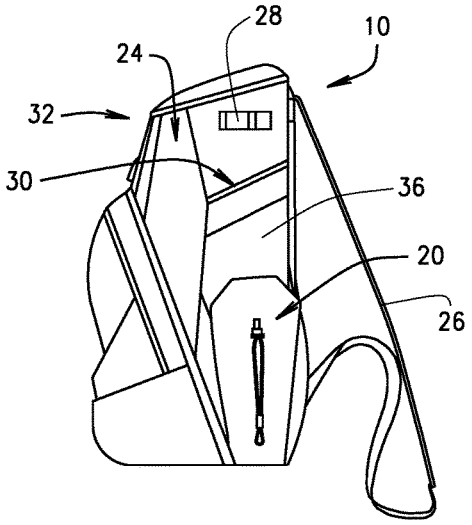
FIG. 2 is a right side elevation view of the bag with shoe pockets of FIG. 1.

As illustrated in FIG. 2, the sleeve members 30 may have an external surface 36 that is reinforced with extra material from which the bag 10 is constructed. The external surface 36 preferably runs the entire length of the sleeve members 30. Alternatively, the external surface 36 may include a different material added to the existing material of a bag, such as extra screen printing a more durable material, or the like. The external surface 36 of a sleeve member 30 forms at least part of an inside surface of a pocket 18, 20. Thus, when a shoe or cleat is inserted into a pocket 18, 20 (as described below), the cleat portion of the shoe may abut the external surface 36. The external surface 36 is reinforced because cleats that abut the surface 36 may be plastic or metal protrusions. Thus, the external surface 36 may help protect the side portions 22, 24 of the bag 10. Because the external surface 36 is preferably reinforced, a bat secured within a sleeve member 30 also may be protected from damage caused by cleats of the shoes.

Figure 3:
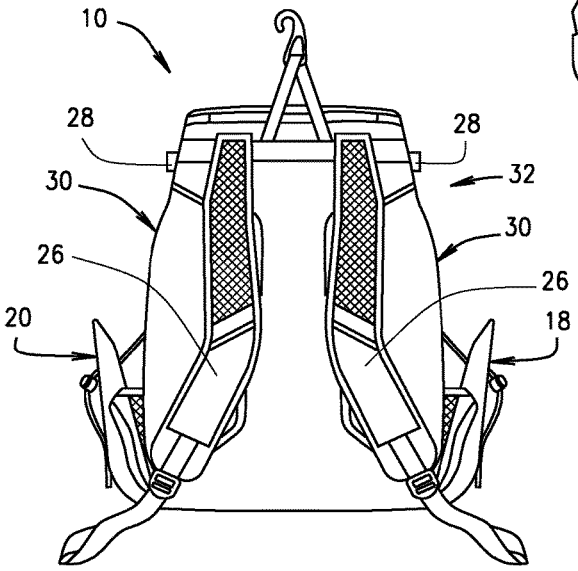
FIG. 3 is a rear elevation view of the bag with shoe pockets of FIGS. 1 and 2.
Figure 4:
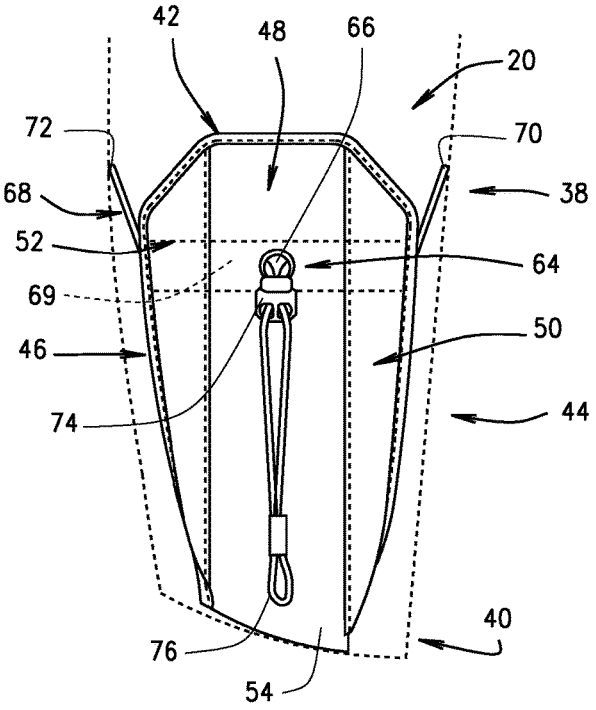
FIG. 4 is an enlarged side elevation view of a shoe pocket of the bag of FIGS. 1-3.
Figure 5:
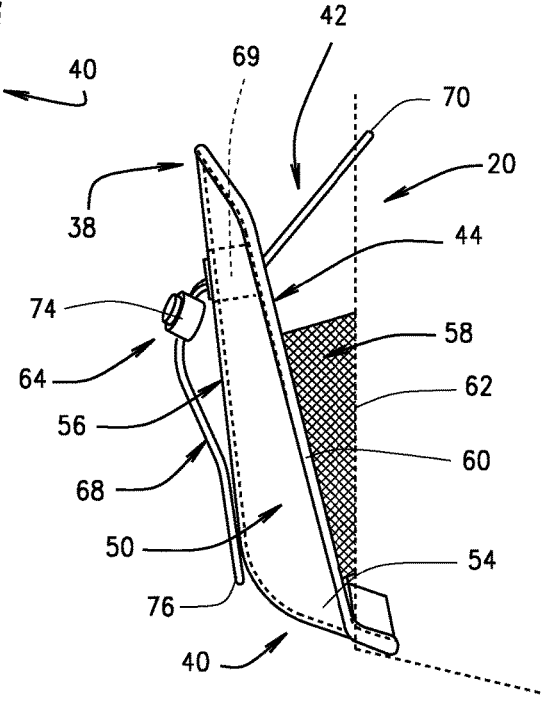
FIG. 5 is a side elevation view of the shoe pocket of FIG. 4 in a closed position.

Turning now to FIGS. 4 and 5, the pocket 20 is illustrated in greater detail than in FIGS. 1-3. The pocket 20 is a substantially mirror image of the pocket 18. Thus, in describing the pocket 20, it should be noted that its description is equally relevant to describing the pocket 18. The pocket 20 preferably includes each of an upper end 38 and lower end 40. The upper end 38 of the pocket 20 is open to the air to form an opening 42 that can receive a shoe that is inserted into the opening 42. On the other hand, the lower end 40 is preferably sewn or otherwise attached to the bag 10 (not illustrated in FIGS. 4 and 5). Thus, when a shoe is within the pocket 20, the shoe is retained in the pocket 20 and does not slide through the pocket 20 and fall out the lower end 40 where it could become lost.

The pocket 20 further preferably includes each of a front facing side 44 and a rear facing side 46. The front facing side 44 is closer to the front of the bag 10 shown in FIG. 1, and the rear facing side 46 is closer to the rear of the bag shown in FIG. 3.

The pocket 20 is preferably generally comprised of a central panel 48, a front panel 50 and a rear panel 52. The front panel 50 is preferably integrally formed with (or otherwise connected to) the central panel 48, and extends from the central panel 48 toward the front of the bag 10. The rear panel 52 is also preferably integrally formed with (or otherwise connected to) the central panel 48, but it extends from the central panel 48 toward the rear of the bag 10. The lower end 40 of the central panel 48 is preferably tapered toward the front panel 50 or the rear panel 52. Thus the deepest portion 54 of the pocket 20 is preferably located at the lower end 40 of the central panel 48 toward the front panel 50. The deepest portion 54 of the pocket 20 is preferably configured to receive and snugly secure the toe of a shoe or cleat being contained therein.

Because the pocket 20 may be used to receive and secure a shoe (with or without cleats), its shape and size substantially resemble the side elevation outline of a shoe. As best shown in FIG. 5, an outward facing profile 56 of the pocket 20 where the panel 50 (or panel 52) and panel 48 intersect is preferably substantially flat, or linear. That profile 56 is sized and shaped to receive a shoe upper along its lacing system so that the substantially flat tongue and lacing system of the shoe abuts the profile 56. The lower end 40 of the pocket 20 is preferably shaped to accommodate the toe of a shoe, and is therefore generally rounded from the profile 56 down to where the pocket 20 connects with the bag 10. As set forth above when describing FIG. 2, the sole portion (which may or may not include cleats) may then substantially abut the external surface 36 (not illustrated in FIG. 5) of the bag 10. When a shoe is received in the pocket 20, the panels 48, 50, 52 all preferably abut the shoe's upper so that the shoe is further secured within the pocket 20. As shown in FIG. 5, the profile 56 of the pocket 20 tapers inwardly as it approaches the lower end 40 of the pocket 20 from its upper end 38. This taper substantially resembles the taper of the top of a shoe as it approaches its toe portion. This specific shape of the pocket 20 allows a shoe to snugly and securely fit therein.

In the embodiment shown in FIG. 5, the side portion 44 of the pocket 20 may not be directly attached to the bag 10. Instead, a generally mesh panel 58 may be attached at a first side 60 to the front panel 50 and at a second side 62 to the bag 10 (not illustrated). The rear panel 52 is preferably also attached to the bag 10 by a mesh panel (not illustrated). The mesh panel 58 is preferably made of an elastic material so that the pocket 20 may be elastically pulled away from the bag 10 when it is receiving a shoe (as discussed below) to increase the size of the opening 42. However, because the mesh is elastic, it returns to form when a shoe is removed from the pocket 10. When a shoe is received in the pocket 20, one side of the shoe preferably abuts the mesh panel 58, and the other side preferably abuts the mesh panel opposite the panel 58 that is not illustrated in FIG. 5. Each mesh panel 58 may be triangular in shape, or may be pleated or the like to allow widening of opening 42, even if mesh panel 58 is not elastic (or even mesh).

The panel 58 is preferably made of a mesh material so that there is airflow provided for shoes stored in a pocket 20 that passes through the mesh. Moreover, the mesh material preferably allows dirt debris from shoes stored in the pocket 20 to fall through the mesh and not accumulate within the pocket 20. In addition to the mesh, other vent holes may be provided in the pockets 20 to improve airflow.

The illustrated mesh panel 58 is not shown located near the upper end 38 of the pocket 20, and instead is only located at substantially the lower end 40 of the pocket 20. In alternative embodiments, the mesh panel 58 (and other mesh panels not shown) may be located only near the upper end 38, or it may substantially cover each of the upper end 38 and the lower end 40.

An adjustment system 64 (see FIGS. 4 and 5) is also preferably provided to further secure a shoe within the pocket 20. As best shown in FIG. 4, the central panel 48 preferably includes an aperture 66 through which a cord member 68 may be strung. The cord member 68 preferably is fed through a retaining strip 69 sewn or otherwise attached to the rear portion (not illustrated) of the pocket 20. Moreover, the cord member 68 is preferably attached at a first end portion 70 to the bag 10 (not illustrated) near the front facing side 44 of the pocket 20. It is also preferably attached at a second end portion 72 to the bag 10 (not illustrated) near the rear facing side 46 of the pocket 20. The cord member 68 may be made of an elastic material.

A poppet member 74 is also preferably provided with the adjustment system 64 that may help to regulate tension within the cord member 68, and thus stabilize the pocket opening 42. When the poppet member 74 is pushed inwardly, a distal portion 76 of the cord member 68 may likewise be pulled outwardly. This action causes the cord member 68 to have increased tension, and thus retain the pocket 20 close to the bag 10 (not illustrated) so that the opening 42 in which shoes may be placed is smaller (see FIG. 5). This opening 42 not being as large may be useful when shoes are either not in the pocket 20 or to apply pressure against the shoes to keep the shoes secured in the pocket 20.

Figure 6:
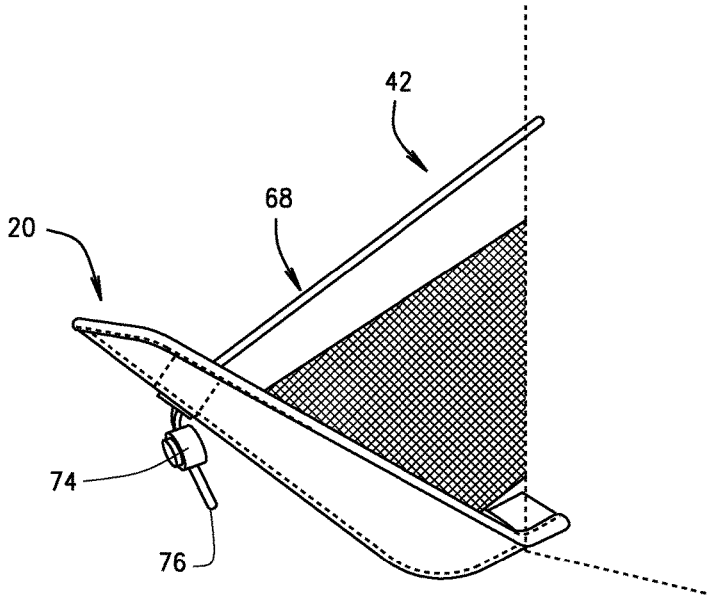
FIG. 6 is a side elevation view of the shoe pocket of FIG. 4 in an open position.

Turning to FIG. 6, the poppet member 74 is pulled outwardly, thus causing the distal portion 76 of the cord member 68 to be shortened. This action causes the cord member 68 to have decreased tension, and thus retain the pocket 20 further from the bag 10 so that the opening 42 in which shoes may be placed is larger. This opening 42 being larger may be useful when a user is ready to place shoes within the pocket 20. A wider opening 42 may make it easier for shoes to be placed within the pocket 20.

Figure 7:
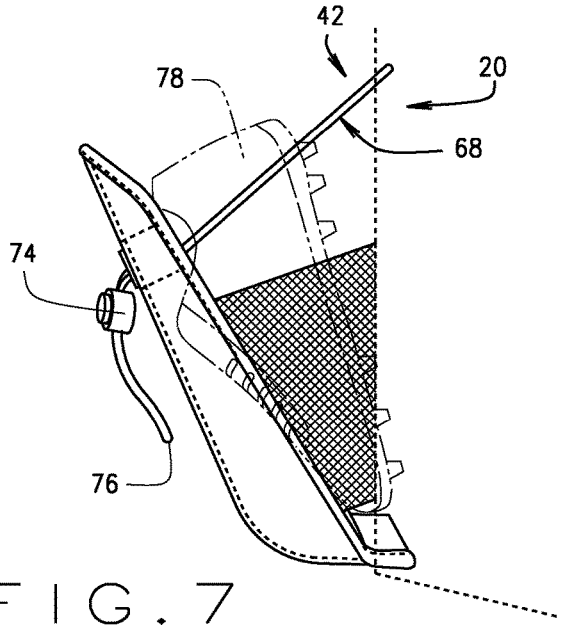
FIG. 7 is a side elevation view of the shoe pocket of FIG. 5 with a shoe stored in the shoe pocket.

Turning to FIG. 7, an example shoe 78 is provided retained within the pocket 20, Moreover, the poppet member 74 has preferably been partially activated using the mechanism described above in describing FIG. 5 so that tension has been increased in the cord member 68, and the opening 42 is smaller. This helps to retain the shoe 78 securely and snugly within the pocket 20.

While the above description of the bag 10 and shoe pockets 18, 20 focuses on the pockets 18, 20 receiving and securing shoes, other objects may be secured within the pockets 18, 20. For example, the pockets 18, 20 may be used to store objects including but not limited to water bottles or sunflower seeds.

Thus, there has been shown and described an equipment bag having shoe pockets for receiving and storing athletic shoes like cleats separate from other equipment contained within the bag. As is evident from the foregoing description, certain aspects of the present inventions are not limited by the particular details of the examples illustrated herein, and it is therefore contemplated that other modifications, applications, variations, or equivalents thereof, will occur to those skilled in the art. Many such changes, modifications, variations and other uses and applications of the present constructions will, however, become apparent to those skilled in the art after considering the specification and the accompanying drawings. All such changes, modifications, variations and other uses in applications which do not depart from the spirit and scope of the present inventions are deemed to be covered by the inventions which are limited only by the claims which follow.

The invention claimed is:

1. A bag for carrying equipment, the bag comprising:

at least one pocket attached to the bag, the pocket including:

a center panel;

a front panel extending outwardly from the center panel toward a front of the bag;

a rear panel extending outwardly from the center panel toward a rear of the bag; and an adjustment system for tightening and loosening an opening in the at least one pocket, the adjustment system including a cord member that extends through each of the center panel, the front panel, and the rear panel;

a first elastic panel attaching the front panel to the front of the bag; and a second elastic panel attaching the rear panel to the rear of the bag.

2. The bag of claim 1, wherein the first elastic panel and the second elastic panel are made of an elastic mesh material.

3. The bag of claim 1, wherein the cord member includes a first end portion attached to a front portion of the bag and a second end portion attached to a rear portion of the bag.

4. The bag of claim 1, wherein each of the front panel, center panel, and rear panel each cover an upper of a shoe when a shoe is inserted in the at least one pocket.

5. The bag of claim 1, wherein the bag includes a sleeve portion adjacent the at least one pocket for receiving and securing a baseball or softball bat barrel.

6. The bag of claim 5, wherein the sleeve portion includes an external surface that is reinforced to protect the bag or a baseball or softball bat when from cleats of a shoe when a shoe is placed in the at least one pocket.

7. The bag of claim 1, wherein the bag includes two pockets, each of the two pockets located on a lower side portion of the bag.

8. The bag of claim 1, wherein the pocket is substantially shoe-shaped.

9. The bag of claim 1, wherein the center, front, and rear panels of the at least one pocket are integrally molded.

10. The bag of claim 1, wherein the center, front, and rear panels are each formed from distinct pieces that are connected together to form the at least one pocket.

11. A bag for carrying equipment, the bag comprising:

at least one pocket attached to the bag at a lower end of the pocket, the pocket including:

a substantially straight profile section; and a rounded lower end that rounds up from the attachment to the bag to the profile section;

first and second elastic panels elastically attaching opposite sides of the profile section to the bag;

an adjustment system for tightening and loosening an opening in the pocket, the adjustment system including a cord member that extends through the profile section of the pocket.

12. The bag of claim 11, wherein the first elastic panel and the second elastic panel are made of an elastic mesh material.

13. The bag of claim 11, wherein the cord member includes a first end portion of the cord member attached to a front portion of the bag and a second end portion attached to a rear portion of the bag.

14. The bag of claim 11, wherein the profile section of the pocket covers an upper of a shoe, and the rounded lower end abuts a toe section of the shoe when the shoe is inserted into the pocket.

15. The bag of claim 11, wherein the bag includes a sleeve portion adjacent the pocket for receiving and securing a baseball or softball bat barrel.

16. The bag of claim 15, wherein the sleeve portion includes an external surface that is reinforced to protect the bag or a baseball or softball bat from cleats of a shoe when a shoe is placed in the pocket.

17. The bag of claim 11, wherein the rounded lower end of the pocket is extends lower at one of a front or rear of the pocket to accommodate a tapered toe section of a left- or right-footed shoe.

* * * * *